United States Patent [19]

Essary

[11] Patent Number: 4,603,787

[45] Date of Patent: Aug. 5, 1986

[54] MULTI-USE JOB BOX

[76] Inventor: Larry Essary, 1663 Corte De Pons, San Jose, Calif. 95124

[21] Appl. No.: 782,521

[22] Filed: Oct. 1, 1985

[51] Int. Cl.[4] ..... B65D 88/00

[52] U.S. Cl. ..... 220/1.5; 220/4 F; 220/210; 220/345; 220/346

[58] Field of Search ..... 220/1.5, 4 F, 4 R, 345, 220/346, 210; 217/12 R, 62

[56] References Cited

U.S. PATENT DOCUMENTS

| | | | |
|---|---|---|---|
| 60,971 | 1/1867 | Walsh . | |
| 263,771 | 9/1882 | Derr . | |
| 395,939 | 1/1889 | Adler . | |
| 836,810 | 11/1906 | Kapus . | |
| 848,393 | 3/1907 | Petrorics . | |
| 1,109,873 | 9/1914 | Schoen . | |
| 1,309,932 | 7/1919 | Bowers . | |
| 2,039,612 | 5/1936 | Stirers . | |
| 2,413,874 | 1/1947 | Keath . | |
| 2,515,007 | 7/1950 | Hunter . | |
| 2,954,252 | 9/1960 | Carpenter | 292/110 |
| 3,830,380 | 8/1974 | Spencer | 220/1.5 |
| 3,915,327 | 10/1975 | Lorich et al. | 220/1.5 |
| 4,009,796 | 3/1977 | Schmidt | 220/345 |
| 4,221,302 | 9/1980 | Kupersmit | 220/345 |
| 4,561,554 | 12/1985 | Swincicki | 220/345 |

*Primary Examiner*—George T. Hall

*Attorney, Agent, or Firm*—Fliesler, Dubb, Meyer & Lovejoy

[57] ABSTRACT

A multi-use job box comprises an open top open front box-like structure having a base having a front edge, a pair of lateral edges and a back edge, a back wall and a pair of side walls, the back wall and the side walls proceeding upwardly from respective edges of the base to respective upper portions a substantially equally spaced distance above the base. The box includes a front panel having a lower edge and an upper edge. The mounting structure serves for pivotally mounting the front panel adjacent the upper edge to the upper portions of each of the side walls with the front panel pivotable to close the open front of the box-like structure. The holding device serves for releasably holding the lower edge of the front panel adjacent to the front edge of the base. An operator may remotely release the holding structure. The box-like structure may be fastened to a lifting device such as a lift truck. The job box is readily dumped if used for holding trash or may be securely locked if tools or the like are to be stored in it.

8 Claims, 10 Drawing Figures

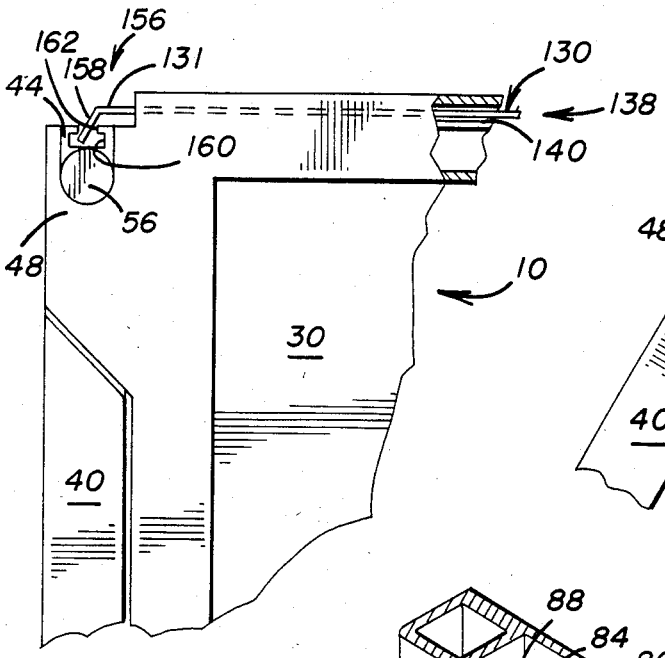
FIGURE 7
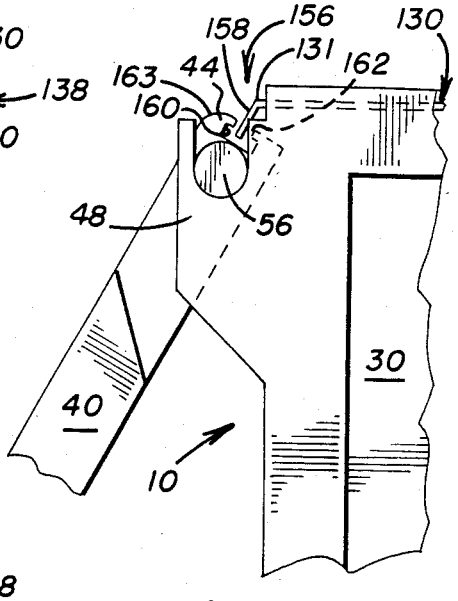
FIGURE 8
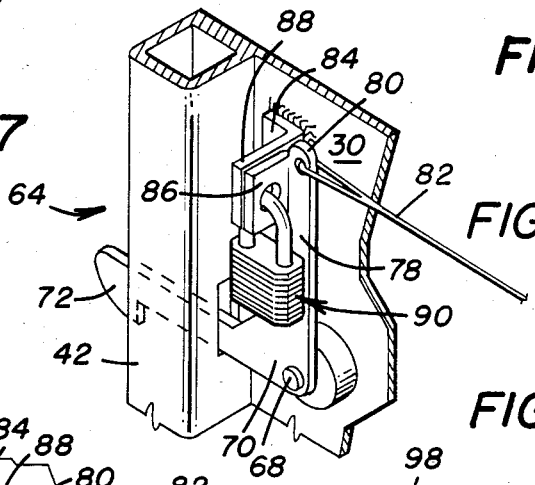
FIGURE 5
FIGURE 4
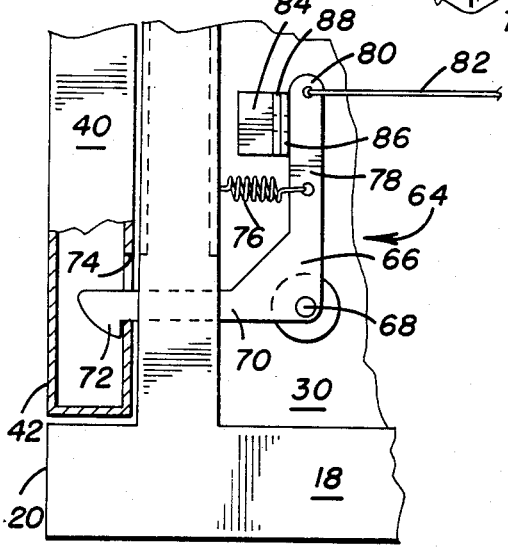
FIGURE 6
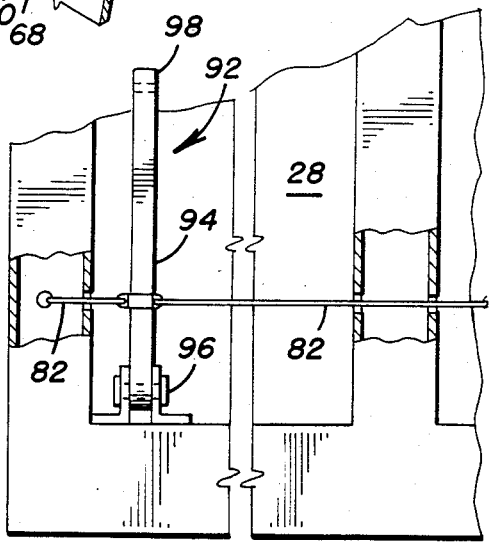

MULTI-USE JOB BOX

TECHNICAL FIELD

The invention relates to a job box having a number of uses around construction sites and the like. The box can be use to collect and dump trash, to lock up tools, or the like. It is adapted for being picked up by a lift truck.

BACKGROUND ART

It is customary around construction sites to construct open top open front box-like structures which can be picked up by a lift truck and into which trash and the like can be dumped. The front is normally left off of such structures since it would otherwise be impossible to dump materials from the box into a larger trash container or the like. Such structures are not satisfactory for a number of reasons. First of all, only relatively small amounts of material may be placed in the box or that material will fall out as the box is being lifted by a lift truck. Second, such open boxes as are presently used are not lockable whereby tools and the like cannot be safely stored in them. Still further, such boxes are not normally attached to the lift truck whereby they cannot be tilted very much without the entire box falling off of the tines of the lift truck. Also, because of their generally plywood construction, such boxes are quite fragile and are easily broken. And, the fabrication of such boxes for each construction job utilizes a good deal of skilled labor time.

Covered dump boxes are known for uses other than construction site use. For example, large metal boxes with hinged tops are utilized for trash disposal at markets and other commercial facilities. These large boxes can be picked up by special dump trucks into which they are emptied by being inverted or can be picked up and carried away to a dump location where they are emptied using special equipment. However, such boxes are not readily lifted up, moved and dumped by the operator of a lift truck. In particular, a conventional lift truck cannot turn such boxes upside down so that the trash will fall out of the open cover.

It would be desirable to have a multi-use job box which could be readily picked up, moved and dumped by a conventional lift truck and the dumping of which could be remotely controlled by the operator of the lift truck. It would be more desirable if such dumping could be accomplished without the box being turned upside down. It would be still more desirable if such boxes could alternatively be used as on the job tool storage facilities by being lockable so that tools and other valuable commodities could be stored in them instead of trash.

DISCLOSURE OF INVENTION

The present invention is directed to overcoming one or more of the problems as set forth above.

In accordance with the present invention a multi-use job box is set forth. The job box comprises an open top open front box-like structure having a generally rectangular base having a front edge, a pair of lateral edges and a back edge, a generally rectangular back wall and a pair of generally rectangular side walls. The back wall and the side walls proceed upwardly generally perpendicularly from respective edges of the base to respective upper portions a substantially equally spaced distance of the base. The box also includes a front panel of generally the same size and shape as the back wall, the front panel having a lower edge and an upper edge. Mounting means serve for pivotally mounting the front panel adjacent its upper edge to the upper portions of each of the side walls with the front panel pivotable to close the open front of the box-like structure. Holding means serve for releasably holding the lower edge of the front panel adjacent to the front edge of the base. Remote releasing means serves for operator remote releasing of the holding means. Fastening means are provided for fastening the box-like structure to a lifting device.

A multi-use job box in accordance with the present invention has a hinged front panel which is lockable in place but which can be released by an operator so as to dump the contents of the box when the box is lifted and moved by a lift truck. Means are also provided for fastening the box-like structure to a lifting device such as a lift truck. In this manner, the box can be tilted to dump material off of the base of the box by releasing the holding means which holds the front panel against the open front of the box-like structure.

BRIEF DESCRIPTION OF DRAWINGS

The invention will be better understood by reference to the figures of the drawings wherein like numbers denote like part throughout and wherein:

FIG. 4 illustrates, in side partially sectioned view, an embodiment of a holding structure useful with the present inevntion;

FIG. 5 illustrates, in perspective, the structure of FIG. 4 with a lock attached thereto;

FIG. 6 illustrates, in back partially sectioned view, an embodiment of a remove releasing structure useful with the present invention;

FIGS. 7 and 8 illustrate, in side view, partially sectioned in FIG. 7, an embodiment of an interlocking structure useful with the present invention in two different positions;

BEST MODE FOR CARRYING OUT INVENTION

Figure 1:
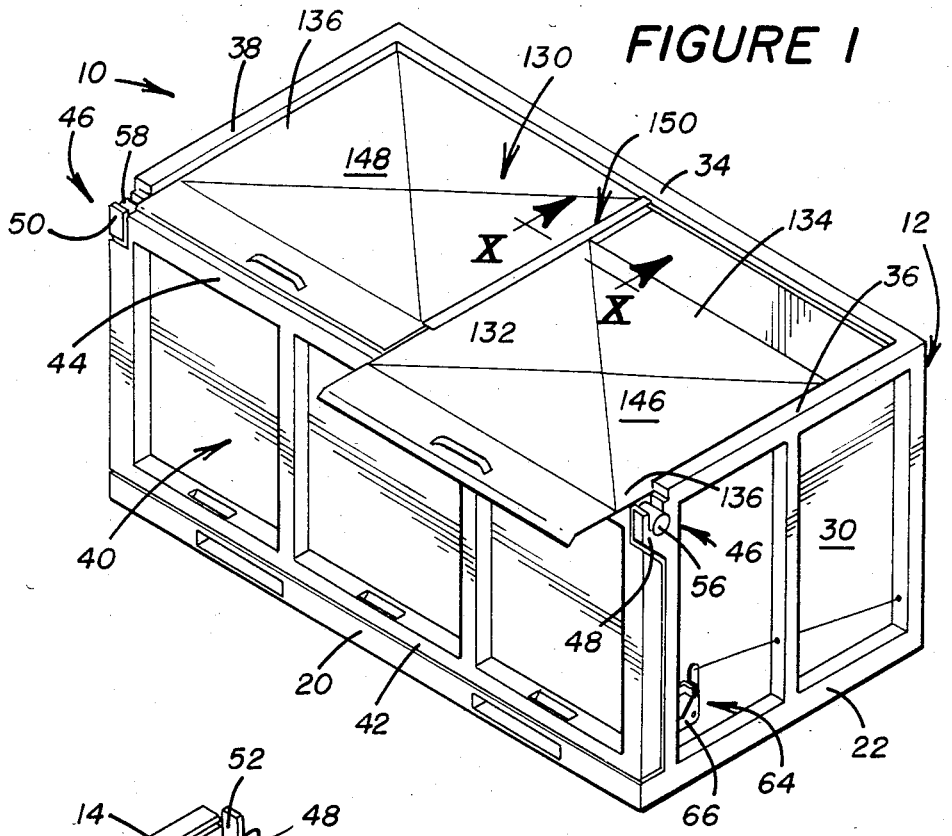
FIG. 1 illustrates, in perspective view from above the front left corner, an embodiment in accordance with the present invention.
Figure 2:
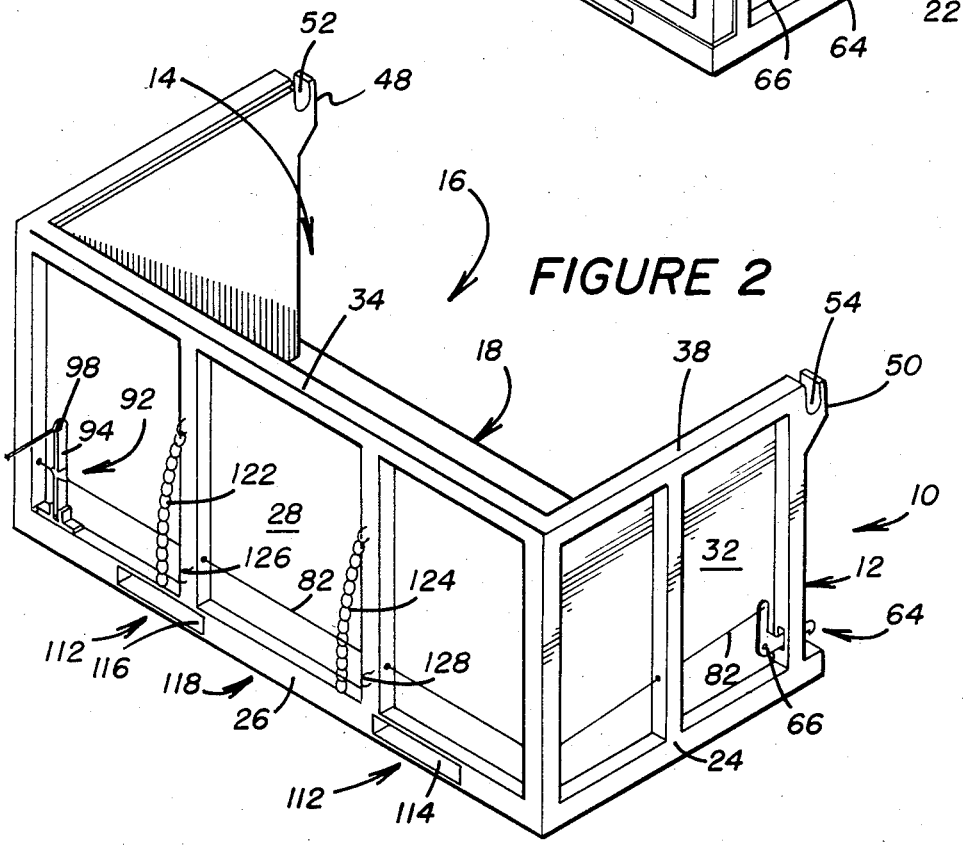
FIG. 2 illustrates, in perspective view from above the rear right corner, the embodiment of FIG. 1 with its cover structure and front panel removed.

The figures of the drawings illustrate a multi-use job box 10 in accordance with an embodiment of the present invention. The job box 10 includes a box-like structure 12 having an open top 14 and an open front 16 (FIG. 2). The box-like structure 12 has a generally rectangular base 18 having a front edge 20 a pair of lateral edges 22 and 24 and a back edge 26. The box-like structure 12 further includes a generally rectangular back wall 28 and a pair of generally rectangular side walls 30 and 32. The back wall 28 and the side walls 30,32 proceed upwardly generally perpendicularly from respective edges 26,22,24 of the base 18 to respective upper portions 34,36,38 a substantially equally spaced distance above the base 18.

A front panel 40 is of generally the same size and shape as is the back wall 28. The front panel 40 has a lower edge 42 and upper edge 44. Mounting means 46 serve for pivotally mounting the front panel 40 adjacent its upper edge 44 to the upper portions 36,38 of each of the side walls 30,32 with the front panel 40 pivotable to close the open front 16 of the box-like structure 12. In the particular embodiment illustrated the mounting means 46 includes a pair of brackets 48,50 which extend from and preferable are integral with the respective side walls 30,32 and which include appropriate circular receptacles 52,54 for short cylindrical rods 56,58 which extend from the upper edge 44 of the front panel 40. Appropriate pins 60,62 serve to hold the cylindrical short rods 56,58 in position.

Holding means 64, seen best in FIGS. 4 and 5 are provided for releasably holding the lower edge 42 of the front panel 40 adjacent to the front edge 20 of the base 18. The holding means 64 includes a pair of L-shaped cranks 66, one mounted pivotally at 68 to each of the side walls 30,32 adjacent the lower edge 42 of the front panel 40. A generally horizontal leg 70 of the crank 66 ends in a hook 72 which extends through an opening 74 adjacent the lower edge 42 of the front panel 40. The hook 72 then bears against and holds an appropriate portion of the front panel 40 adjacent its lower edge 42. A spring 76 acts between the respective side wall 30 or 32 and a generally vertical arm 78 of the crank 66. The spring 76 biases the generally vertical arm 78 in such a manner that the hook 72 holds the front panel 40 in place. The vertical arm 78 of the crank 66 extends upwardly beyond the spring 76 to an upper end 80. If the upper end 80 of the generally vertical arm 78 is pulled outwardly by pulling on a wire 82, the force of the spring 76 is overcome and the hook 72 is pivoted upwardly until it is opposite the opening 74. When this occurs, the front panel 40 is no longer held in place adjacent its lower edge 42 and the panel 40 can pivot outwardly about the mounting means 46. A bracket 84 is attached to the side walls 30,32 adjacent the upper end portion 80 of the generally vertical arm 78 of the crank 66. The upper portion 80 of the arm 78 also includes a structure 86 which extends to adjacent a portion 88 of the bracket 84. Appropriate holes are present in alignment in the structure 86 and the portion 88 of the bracket 84 whereby a lock 90 can be fastened in place so that the wire 82 cannot act to overcome the force of the spring 76. Thus, the holding means 64, in the preferred embodiment of the present invention, includes the releasable lock 90 which prevents release of the holding means 64 when the lock 90 is engaged.

Figure 3:
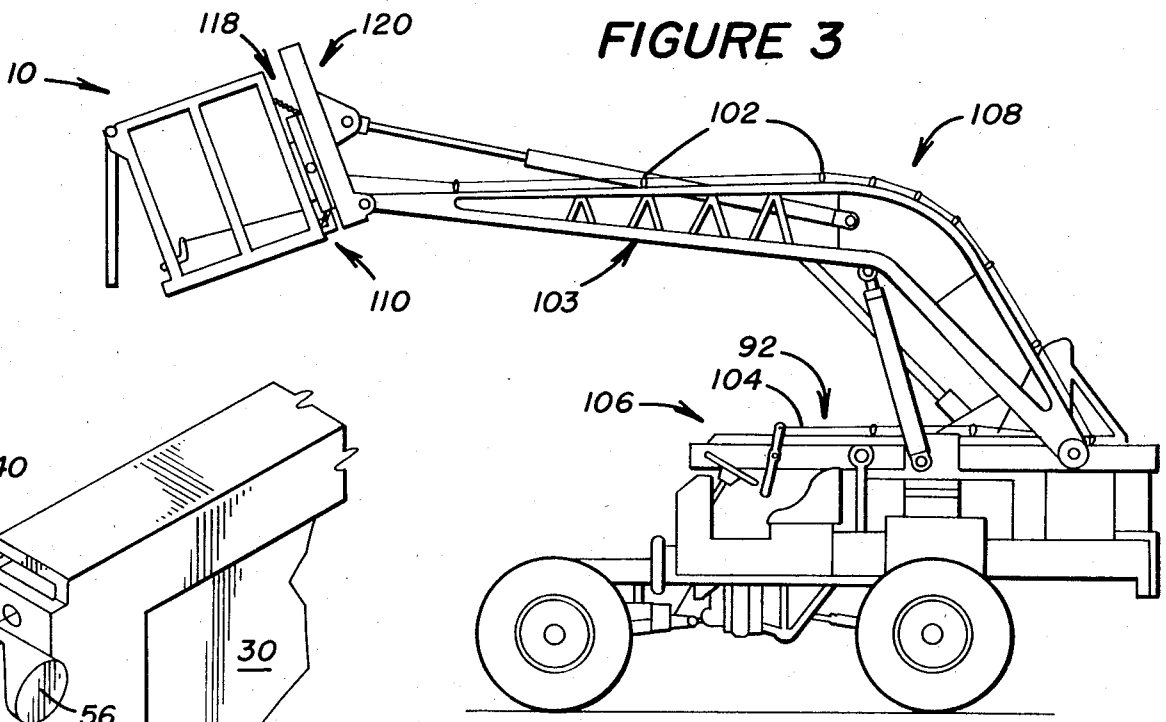
FIG. 3 illustrates, in side view, a lift truck to which the embodiment of FIG. 1 is mounted.
Figure 10:
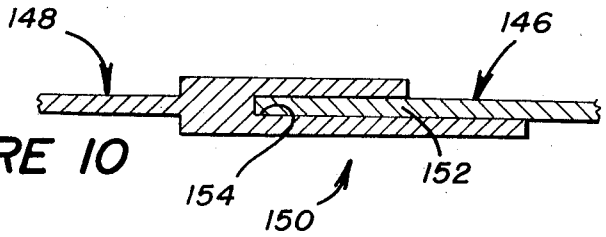
FIG. 10 illustrates a view taken along the line X—X of FIG. 1.

Remote releasing means 92 (FIGS. 2, 3 and 6) serve for operator remote releasing of the holding mean 64. Any of a number of remote releasing means 92 may be utilized, for example electrically operated, hydraulically operated or pneumatically operated remote releasing means 92 are contemplated as being usable. In the particular embodiment illustrated in the drawings the remote releasing means 92 is in the form of a lever 94 which is pivotally mounted at 96 to the back wall 28. A pair of the wires 82 are attached to the lever 94 intermediate its point of pivoting 96 and a removed end 98 of the lever 94. When the removed end 98 of the lever 94 is pulled outwardly from the back wall 28 the wires 82 are both pulled upon. This results in the pulling force being exerted against the end 80 of the crank 66 thereby releasing the hook 72 which holds the front panel 40 in place. The remote releasing means 92 may be located substantially anywhere along the back of the back wall 28 where it is convenient. In the particular embidiment illustrated it is located adjacent one of the side walls 30,32. A wire 100 (FIG. 3) extends from the end 98 of the lever 94 through appropriate guides 102 along a mast 103 to place an end 104 of the wire 100 in the grasp of an operator within a cab 106 of a lift truck 108. Thus, an operator can remotely control release of the holding means 64.

Fastening means 110 (FIGS. 2 and 3) serve for fastening the box-like structure 12 to a lifting device such as the lift truck 108. The fastening means 110 includes a tine accepting construction 112 which is adapted to receive the tines of the lift truck 108. In the particular embodiment illustrated the tine accepting construction 112 is simply in the nature of tine accepting cavities 114 and 116 in the base 18 and which extend from the back edge 26 thereof forwardly. The fastening means 110 preferably further includes an attaching arrangement 118 which is adapted to attach, e.g., strap, the back wall 28 of the box-like structure 12 to a carriage 120 of the lift truck 108. While any of a number of attaching arrangements 118 can be utilized, the embodiment illustrated shows an attaching arrangement 118 in the nature of a pair of chains 122,124 and hooks 126,128. The chains 122,124 simply fasten over the carriage 120 and are engaged near their ends with the hooks 126,128. The attaching arrangement 118 allows the job box 10 to be tilted far forwardly during the dumping operation whereby it can be thoroughly and readily emptied.

Figure 9:
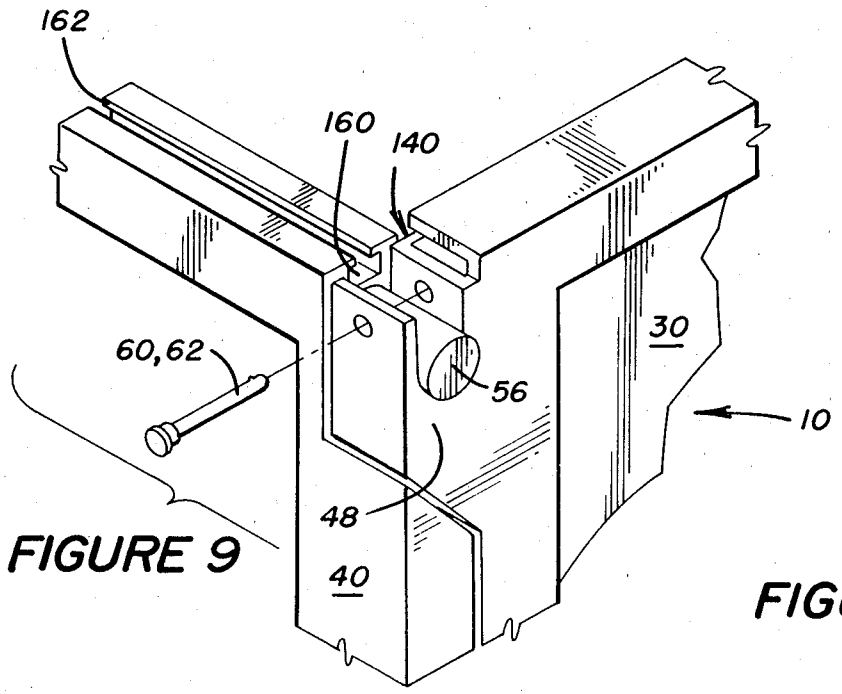
FIG. 9 illustrates, in partial view in perspective, a detail in an embodiment of the present invention.

In accordance with the present invention the job box 10 of the present invention preferably includes a lid structure 130 having front, back and lateral edge portions 132,134,136. The lid structure 130 is sized to fit adjacent the upper portions 34,36,38 of the back wall 28 and the side walls 30,32. The lid structure 130 is positionable generally parallel to the base 18 and serves to close the open top 14. Means 138 serves for slidably interlockingly engaging the back and lateral edge portions 132,134,136 of the lid structure 130 with the upper portions 34,36,38 of,-respectively, the back wall 28 and the side walls 30,32. In the particular embodiment illustrated the interlockingly engaging means 138 is in the nature of respective grooves, such as the groove 140 seen in FIGS. 7 and 9, respectively, the upper portions 34,36,38 of the back wall 28 and the side walls 30,32. The lateral edge portions 132,134,136 of the lid structure 130 simply fit within the appropriate groove 140 and act as the tongue portion of a tongue and groove structure.

The lid structure 130 is preferably in the nature of a pair of lids 146,148 in which case means 150 are provided for slidably interlockingly engaging the lids 146 and 148 with one another. The basic engagement is again in the nature of a tongue and groove arrangement, for example with a tongue 152 defined by the lid 146 fitting within a groove 154 defined by the lid 148. Use of a pair of lids 146,148 allows for easy assembly and adds to ease in construction of the box 10.

In accordance with a preferred embodiment of the present invention interlocking means 156 (FIGS. 7 and 8) is provided for interlocking the upper edge 44 of the front panel 40 with the front edge portion 131 of the lid structure 130 for preventing removal of the lid structure 130 when the front panel lower edge 42 is held by the holding means 64. In the particular embodiment illustrated the interlocking means 156 includes a downwardly bent portion 158 of the front edge portion 131 of the lid structure 130. Interlocking means 156 further includes a groove 160 extending downwardly into the upper edge 44 of the front panel 40. The groove 160 has a restricted mouth 162 into which the downwardly bent portion 158 of the front edge portion 131 can only fit when the front panel 40 is fitted whereby its lower edge 42 is spaced away from the front edge 20 of the base 18. In FIG. 8 the front panel 40 is shown as being rotated approximately 30° from that position wherein the lower edge 42 of the front panel would contact the front edge 20 of the base 18. In this position, the downwardly bent portion 158 of the front edge portion 131 of the lid structure 130 fits readily through the restricted opening 168 in the upper edge 44 of the front panel 40 (the metal of which the lid structure 130 is formulated is selected to flex sufficiently so the downwardly bent portion 158 will ride along the surface 163 and snap down into the gorrve 160). When the front panel 40 is rotated until the lower edge 42 thereof contacts the front edge 20 of the base 18, the downwardly bent portion 158 of the front edge portion 131 of the lid structure 130 is interlocked within the groove 160 and lid structure 130 cannot be removed. This occurs whenever the front panel lower edge 42 is held by the holding means 62. In this manner, security of the contents of the box 10 is assured.

Industrial Applicability

A job box 10 in accordance with the present invention is useful for storing trash for later dumping and/or for storing valuable articles under lock and key.

While the invention has been described in connection with certain preferred embodiments thereof it will be obvious that modifications and changes may be made in the invention by those skilled in the art to which it pertains without departing from the scope of the invention as defined by the appended claims.

I claim:

1. A multi-use job box, comprising:

an open top open front box-like structure having a generally rectangular base having a front edge, a pair of lateral edges and a back edge, a generally rectangular back wall and a pair of generally rectangular side walls, the back wall and the side walls proceeding upwardly generally perpendicularly from respective edges of the base to respective upper portions a substantially equally spaced distance above the base;

a front panel of generally the same size and shape as the back wall, the front panel having a lower edge and a upper edge;

mounting means for pivotally mounting the front panel adjacent the upper edge to the upper portions of each of the sidewalls with the front panel pivotable to close the open front of the box-like structure;

holding means for releasably holding the lower edge of the front panel adjacent to the front edge of the base;

remote releasing means for operator remote releasing of the holding means; and fastening means for fastening the box-like structure to a lifting device.

2. A job box as set forth in claim 1, further including:

a lid structure having front, back and lateral edge portions and being sized to fit adjacent said upper portions of said back wall and said side walls and being positionable generally parallel to said base to close said open top; and means for slidably interlockingly engaging said back and lateral edge portions of said lid structure with said upper portions of, respectively, said back wall and said side walls.

3. A job box as set forth in claim 2, further including:

interlocking means for interlocking said upper edge of said front panel with said front edge portion of said lid structure for preventing removal of said lid structure when said front panel lower edge is held by said holding means.

4. A job box as set forth in claim 1, wherein said fastening means includes a tine accepting construction adapted to receive the tines of a lift truck.

5. A job box as set forth in claim 4, wherein said fastening means further includes an attaching arrangement adapted to attach said back wall to a carriage of the lift truck.

6. A job box as set forth in claim 1, wherein said holding means includes a releasable lock for preventing release of said holding means when said lock is engaged.

7. A job box as set forth in claim 2, wherein said lid structure includes a pair of lids and means for slidably interlockingly engaging said lids with one another.

8. A multi-use job box, comprising:

an open top open front box-like structure having a generally rectangular base having a front edge, a pair of lateral edges and a back edge, a generally rectangular back wall and a pair of generally rectangular side walls, the back wall and the side walls proceeding upwardly substantially perpendicularly from respective edges of the base to respective upper portions a substantially equally spaced distance of the base;

a front panel of generally the same size and shape as the back wall, the front panel having a lower edge and an upper edge;

mounting means for pivotally mounting said front panel adjacent said upper edge of said front panel to said upper portions of each of said sidewalls with said front panel pivotable to close said open front of said box-like structure;

holding means for releasably holding said lower edge of said front panel adjacent to said front edge of said base;

a lid structure having front, back and lateral edge portions and being sized to fit adjacent said upper portions of said back wall and said side walls and being positionable generally parallel to said base to close said open top;

means for slidably interlockingly engaging said back and lateral edge portions of said lid structure with said upper portions of, respectively, said back wall and said side wall; and interlocking means for interlocking said upper edge of said front panel with said front edge portion of said lid structure for preventing removal of said lid structure when said front panel lower edge is held by said holding means.

* * * * *